US008820959B2

(12) United States Patent
Nevins et al.

(10) Patent No.: US 8,820,959 B2
(45) Date of Patent: Sep. 2, 2014

(54) HYBRID SOURCE LIGHTING SYSTEM

(76) Inventors: Michael O. Nevins, Jackson, MI (US); Keith E. Graeber, Oakland, CA (US); Michael Jay Siminovitch, Oakland, CA (US); Konstantinos Papamichael, Oakland, CA (US)

( * ) Notice: Subject to any disclaimer, the term of this patent is extended or adjusted under 35 U.S.C. 154(b) by 297 days.

(21) Appl. No.: 13/342,613

(22) Filed: Jan. 3, 2012

(65) Prior Publication Data

US 2012/0195036 A1 Aug. 2, 2012

Related U.S. Application Data

(60) Provisional application No. 61/429,286, filed on Jan. 3, 2011.

(51) Int. Cl.
*F21V 9/00* (2006.01)
*F21V 21/00* (2006.01)

(52) U.S. Cl.
CPC . *F21V 9/00* (2013.01); *F21V 21/00* (2013.01); *Y10S 362/802* (2013.01)
USPC ..... 362/230; 362/231; 362/802

(58) Field of Classification Search
USPC ..... 362/230, 231, 802
See application file for complete search history.

(56) References Cited

U.S. PATENT DOCUMENTS

| | | | | |
|---|---|---|---|---|
| 6,471,369 | B1 * | 10/2002 | Valella, Jr. | 362/230 |
| 7,575,357 | B2 * | 8/2009 | Wu et al. | 362/613 |
| 2008/0298052 | A1 * | 12/2008 | Hurst et al. | 362/231 |
| 2009/0122536 | A1 * | 5/2009 | Scholz | 362/234 |
| 2010/0008087 | A1 * | 1/2010 | Rains et al. | 362/231 |

* cited by examiner

*Primary Examiner* — Laura Tso
(74) *Attorney, Agent, or Firm* — Lowe Hauptman & Ham, LLP

(57) ABSTRACT

A lighting fixture system, comprising a first illuminant, a secondary illuminant; and a sensor configured to detect a predetermined condition, the sensor being coupled to the first illuminant and the secondary illuminant, the first illuminant and the secondary illuminant comprising different light sources, the sensor configured to cause modulation of the first illuminant and the secondary illuminant in response to detection of the pre-determined condition.

21 Claims, 17 Drawing Sheets

HYBRID SOURCE LIGHTING SYSTEM

RELATED APPLICATIONS

The present application is based on, and claims priority from, Provisional Application No. 61/429,286, filed Jan. 3, 2011.

BACKGROUND

Traditional bi-level light fixture systems involve the use of a single illuminant that is controlled with Infrared or ultrasonic sensors to reduce the flux output from a high level during occupancy to a predefined reduced level during periods of vacancy. This control technology is typically applied to single or multiple sources of the same spectrum or color temperature characteristic.

There is a growing concern that certain light levels at night may result in biological disturbance or imbalances within certain species due to the hormonal stimulation that occurs with shorter wavelengths corresponding to typical high color temperature light sources. For example, there is growing evidence from the vision science community indicating adverse impacts on humans associated with wavelengths shorter than 500 nanometers (nm) that occur from lighting at night. Studies have shown that human circadian rhythm is mediated by photoreceptors within the eye with a peak response near 450 nm, i.e., typically the blue portion of the visible light spectrum. Exposure to blue light within this critical action spectrum shorter than 500 nm can suppress the normal production of melatonin, a critical hormone that mediates sleep function and other physical responses.

The total amount of light flux entering the sky and disrupting natural wildlife in areas adjacent to the parking and area lighting complexes can have a disruptive effect on wildlife in a similar manner to what is currently being studied with humans.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Some embodiments of the adaptive hybrid lighting system described herein predominantly emit an amber light a lower level or lower impact light, e.g., during night time hours and switch over to emitting a wide spectrum for safety and security based on pre-determined conditions, such as occupancy, time, day, and/or emergencies. During periods of vacancy, the lighting fixture responds via an integrated sensor and switches the hybrid fixture to a secondary source, e.g., lower power secondary source at a significantly lower color temperature, such as, but not limited to, an amber LED.

Amber LEDs emit a dramatically reduced color temperature, which alleviates the potential for biological disturbances resulting from bluer spectrum light sources, while also maintaining safety, security, and comfort during periods of vacancy. Other embodiments use different color LEDs depending on the nature of the intended use, including red, orange, green, and RGB color changing LEDs.

Reducing the amount of light projected at night within the blue end of the spectrum alleviates human impact disturbances to people near or adjoining illuminated areas, such as parking lots, parking garages, walkways and the like. The hybrid nature of the lighting system means that for most of the hours of operation typically 50 to 75% of the lighting system will be operating within the amber part of the spectrum at a greatly reduced intensity, away from the critical action spectrum in terms of hormonal response for humans and other mammals and birds.

One or more embodiments described herein also provide the advantage of significant energy savings, while maintaining visual comfort and security within the lighting area. The predominant savings with one or more of the described embodiments occurs by reducing a portion of the power utilized to produce a broad white light source for periods of high demand for white light. During periods of vacancy, the lighting fixture is dramatically reduced and the wavelength generated is shifted to a lower level, e.g., only amber given that no critical tasks are ongoing. Both the reduced power and the shift in spectrum create a significant reduction in energy use.

Figure 1:
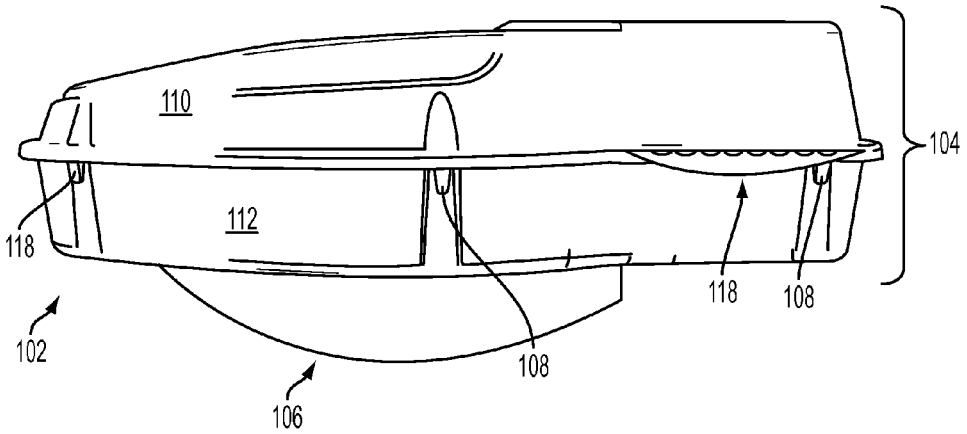
FIG. 1 is a side view of a shoe box type light fixture according an embodiment of a bi-level hybrid light fixture.

FIG. 1 is a side view of a bi-level hybrid lighting device 100 having a shoe box type light fixture 102 according to an embodiment of the present invention. The shoe box type light fixture 102 comprises a first illuminant 302 (FIG. 3) and a secondary illuminant 118. In this embodiment, the first illuminant 302 is a higher power light source than the secondary illuminant 118.

The first illuminant 302 is preferably a magnetic induction lamp and powered by an induction-based light source in order to provide increased lifespan and/or reduce a required initial energy requirement for illumination. An induction-based light source does not use electrical connections through a lamp in order to transfer power to the lamp. Electrode-less lamps transfer power by means of electromagnetic fields in order to generate light. In an induction-based light source, an electric frequency generated from an electronic ballast is used to transfer electric power to an antenna coil within the lamp. In accordance with at least some embodiments, first illuminant 302 may have an increased lifespan with respect to other types, e.g., incandescent and/or florescent light sources having electrodes. In accordance with at least some embodiments, first illuminant 302 may have a reduced initial energy requirement for start up of the light source. In at least some embodiments, first illuminant 302 is electrically connected, either directly or indirectly, to a power source.

The lower power secondary illuminant 118 is preferably a light emitting diode (LED), which is powered using a current-regulated AC to DC converter. In another embodiment, the secondary illuminant 118 is an end auction fluorescent coupled with an amber LED. Potential variants on this embodiment would include different spectral outputs of LED including red, amber, green and various combinations. A feature of one or more embodiments is reducing the amount of flux both in terms of intensity and spectrum away from the critical action spectrum at 450 nm. This is achievable with other spectra besides Amber such as red LED. Additional embodiments involve different broad-spectrum lights and light sources, including induction, fluorescent, linear fluorescent, compact fluorescent, and other discharge lamps including both low or high pressure.

Shoe box type light fixture 102 (FIG. 1) comprises a case 104 and a lens 106. Case 104 comprises a first housing 110 and a second housing 112. First housing 110 and second housing 112 are removably attached by removable fasteners 108. Removable fastener 108 is a threaded screw. In other embodiments, removable fastener 108 includes a compression fitting, nut and bolt, snap fitting or similar fasteners. In yet other embodiments, case 104 is a single unibody construction.

Case 104 is constructed of 80% recycled polycarbonate resin. In other embodiments, case 104 is constructed of metal and/or other plastics.

Second housing 112 is adapted to receive a lens 106 through an opening. Lens 106 is an acrylic lens. In other embodiments, the lens is constructed of clear plastic, glass, or other similar transparent material. In other embodiments, lens 106 is constructed of a partially transparent material.

Figure 19:
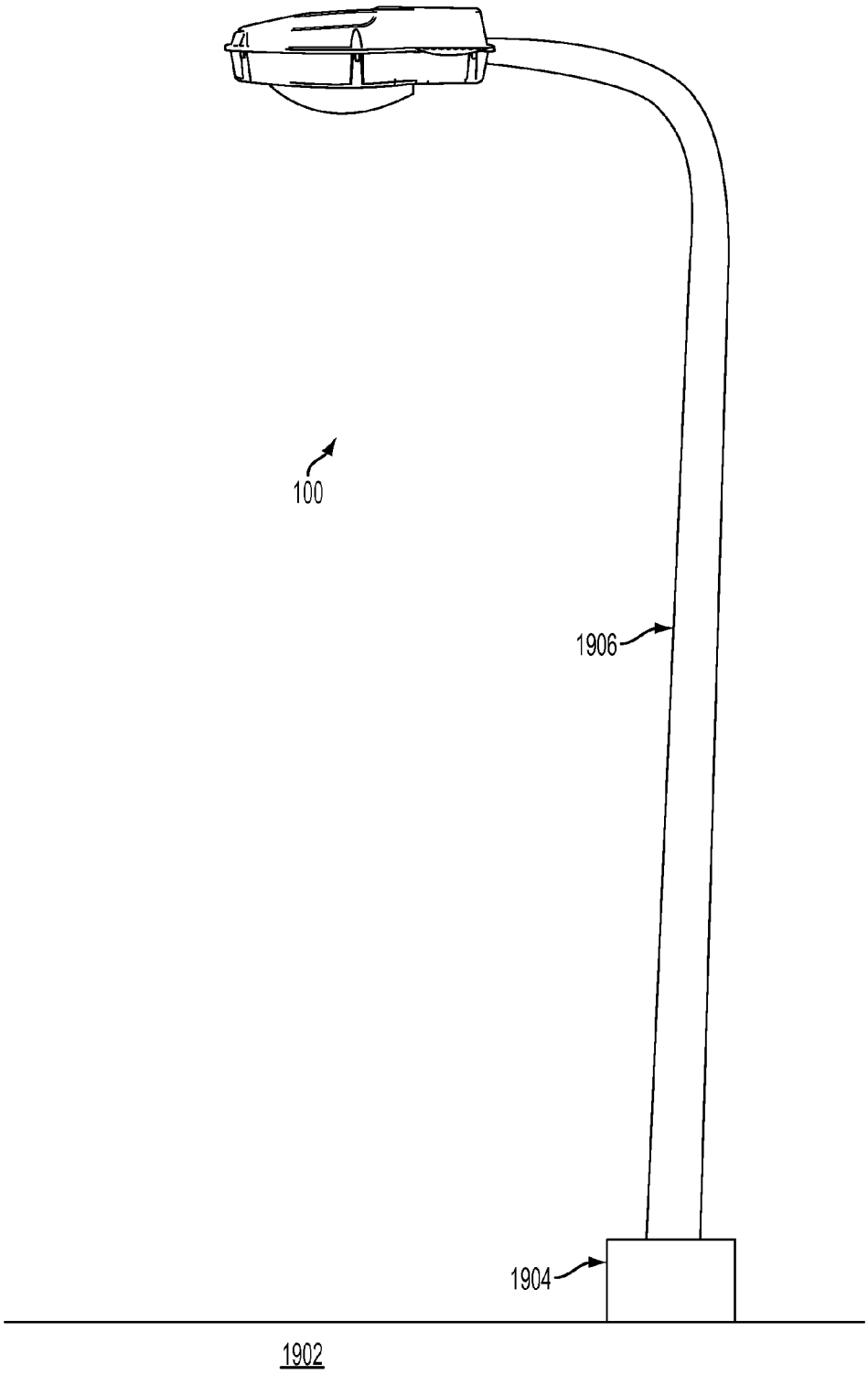
FIG. 19 is a side view of a shoe box type light fixture installed on a surface.

FIG. 19 is a side view of a shoe box type light fixture 102 installed on a surface 1902 by way of a pedestal 1904. In at least some embodiments, surface 1902 comprises ground, roadway, or other supporting surfaces. In at least some embodiments, pedestal 1904 comprises any of a number of supportive materials such as stone, concrete, metal, etc.

Shoe box type light fixture 102 comprises a vertically extending support pole 1906. In at least some embodiments, support pole 1906 extends horizontally or at a different angle in-between horizontal and vertical. In at least some embodiments, support pole 1906 is hollow; however, in other embodiments different configurations are possible. In at least some embodiments, support pole 1906 is comprised of metal, plastic, concrete and/or a composite material.

In at least some embodiments, support pole 1906 also provides a conduit through which electricity is supplied to the light fixture. For example, a connection to a mains or other power source may be provided.

Figure 2:
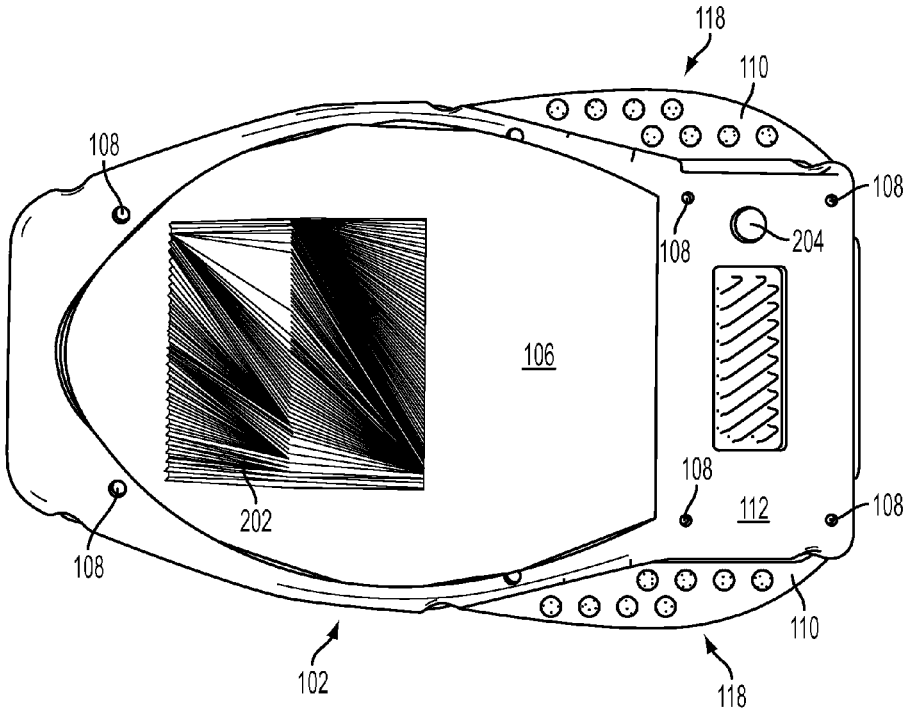
FIG. 2 is a bottom view of the FIG. 1 shoe box type light fixture.

FIG. 2 depicts a bottom view of shoe box type light fixture 102. Lens 106 is treated with Type IV prescription 202. In other embodiments, lens 106 is not treated with a prescription.

Figure 3:
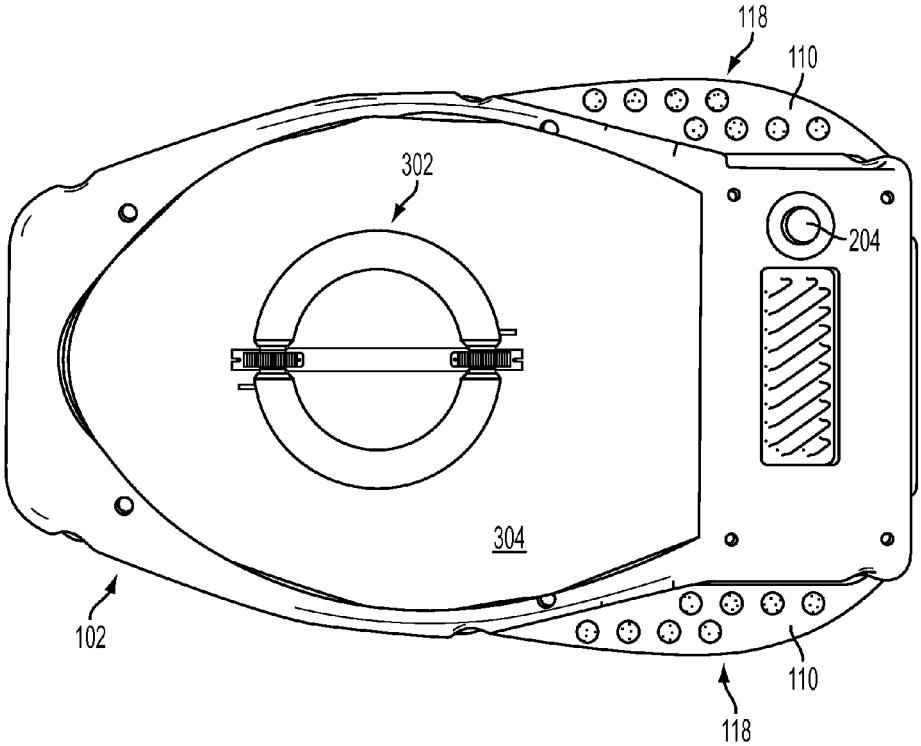
FIG. 3 is a bottom view of the FIG. 1 shoe box type fixture having a lens removed.

FIG. 3 depicts the shoe box type light fixture 102 (FIG. 1), wherein lens 106 is removed from case 104. Case 104 comprises an interior surface 304, which is adapted to receive a first illuminant 302. The first housing 110 of case 104 is adapted to receive a plurality of secondary illuminants 118. In other embodiments, case 104 is adapted to receive a plurality of secondary illuminants 118. In yet other embodiments, second housing 112 is adapted to receive secondary illuminant 118.

A plurality of secondary illuminants 118 is depicted in the shoe box type light fixture 102 (FIG. 1). In other embodiments, a single secondary illuminant is utilized depending on the intensity and desired effects of the secondary illuminant.

A sensor 204 is attached to second housing 112. In other embodiments, sensor 204 is attached to case 104 or to first housing 104. Sensor 204 is connected, e.g., electrically or communicatively, to first illuminant 302 and secondary illuminant 118. Sensor 204 modulates shoe box type light fixture 102 to emit different spectrums of light or sources of light based on pre-determined conditions, such as occupancy, time, day, and/or emergencies.

Sensor 204 is electrically connected to the induction based light source of first illuminant 302 and the current-regulated AC to DC converter source of secondary illuminant 118. After sensor 204 detects occupancy or presence of a person or being or motion within the lighting application or area, sensor 204 activates the induction based light source thereby powering first illuminant 302. During periods of vacancy, sensor 204 deactivates the induction based light source, and switches the shoe box type light fixture 102 to power the source of secondary illuminant 118 at a significantly lower color temperature, such as, but not limited to, an amber LED.

Sensor technology is determined as appropriate for the application, and may include passive infrared (PIR) and/or Microwave occupancy sensors, as well as ultrasonic sensors. Spectral or source modulation may also be accomplished through a communication network, such as a wired or wireless connection giving a facility manager manual or scheduled access to activate or deactivate the bi-level hybrid lighting device.

This modulation between higher power first illuminant 302, which creates a bluer spectrum of light, and lower power secondary source 118, e.g., an amber LED, significantly alleviates the potential for biological disturbances resulting from the bluer spectrum light sources during periods of vacancy. An additional advantage of this lighting system is that some level of flux is maintained during periods of vacancy maintaining safety, security, and comfort.

In this arrangement, by reducing the spectral power distribution, the shoe box type light fixture 102 reduces the total power consumption and achieves energy savings in at least some embodiments.

Figure 4:
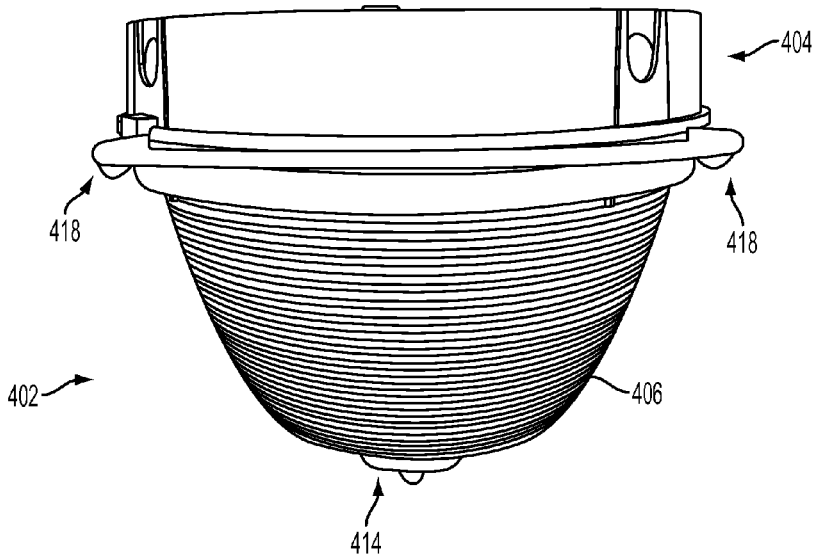
FIG. 4 is a side view of the garage type light fixture according to an embodiment of a bi-level hybrid light fixture.

FIG. 4 is a side view of a bi-level hybrid lighting device having a garage type light fixture 402 according to an embodiment of the present invention. Garage type light fixture 402 comprises a case 404 and a lens 406. Affixed to lens 406 is a sensor 414.

Figure 5:
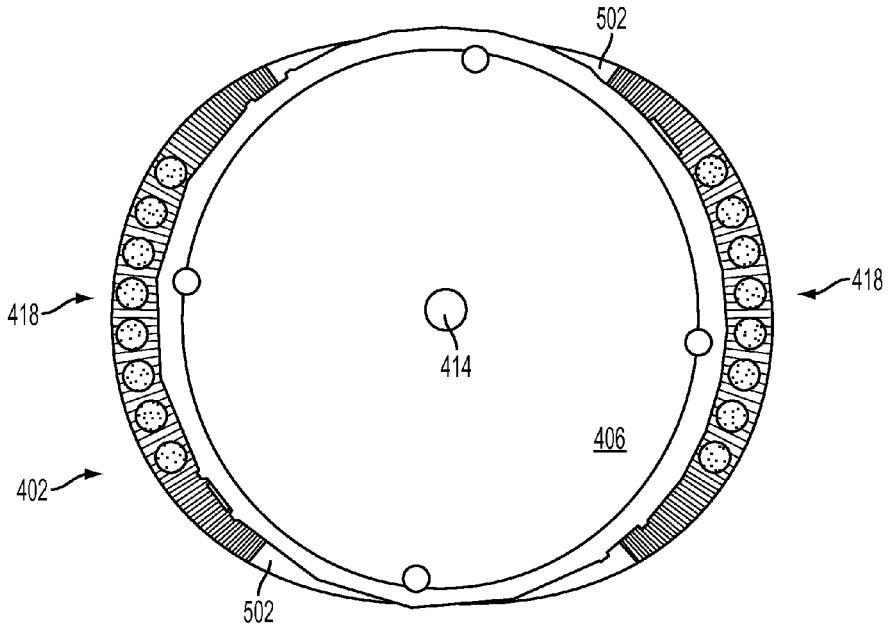
FIG. 5 is a bottom view of the FIG. 4 garage type light fixture.

FIG. 5 is a bottom view of garage type light fixture 402 (FIG. 4). Lens 406 is affixed to case 404 by way of a twist-lock ring. In other embodiments, lens 406 may be affixed to case 404 by way of a fastener or compression fitting.

Case 404 comprises a rim 502 attached to or having attached thereto a plurality of secondary illuminants 418. In other embodiments, a single secondary illuminant is used depending on the intensity and desired effects of the secondary illuminant.

Figure 6:
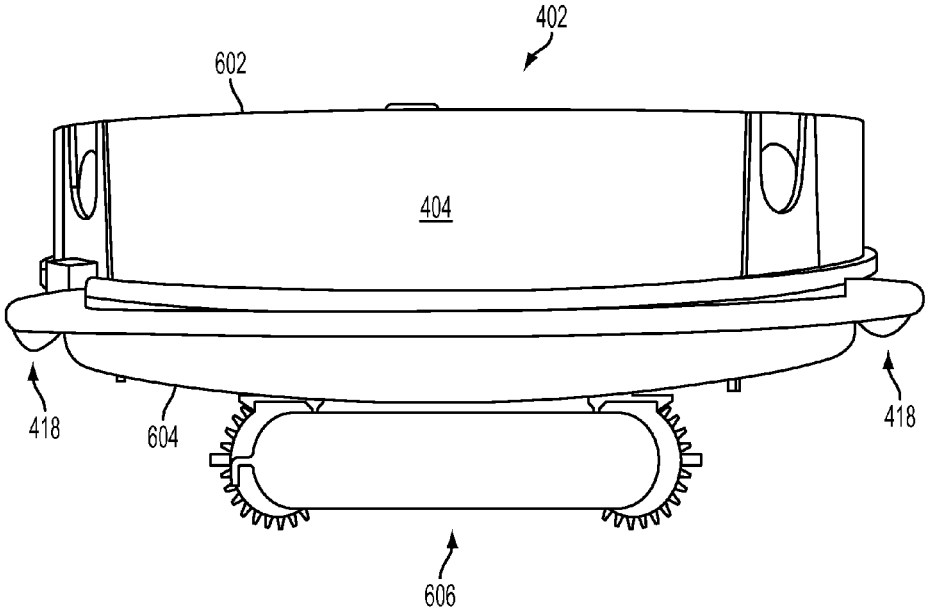
FIG. 6 is a side view of the FIG. 4 garage type light fixture having a lens removed.

FIG. 6 is a side view of garage type light fixture 402 (FIG. 4), wherein lens 406 is removed to reveal a first illuminant 606 affixed to a surface 604 of case 404.

Garage type light fixture 402 comprises an edge 602. Edge 602 removably attaches to a mountable surface, such as a garage, canopy, parking structure, and adapted to receive a power source to supply power to the first illuminant 606 and secondary illuminant 418.

Figure 7:
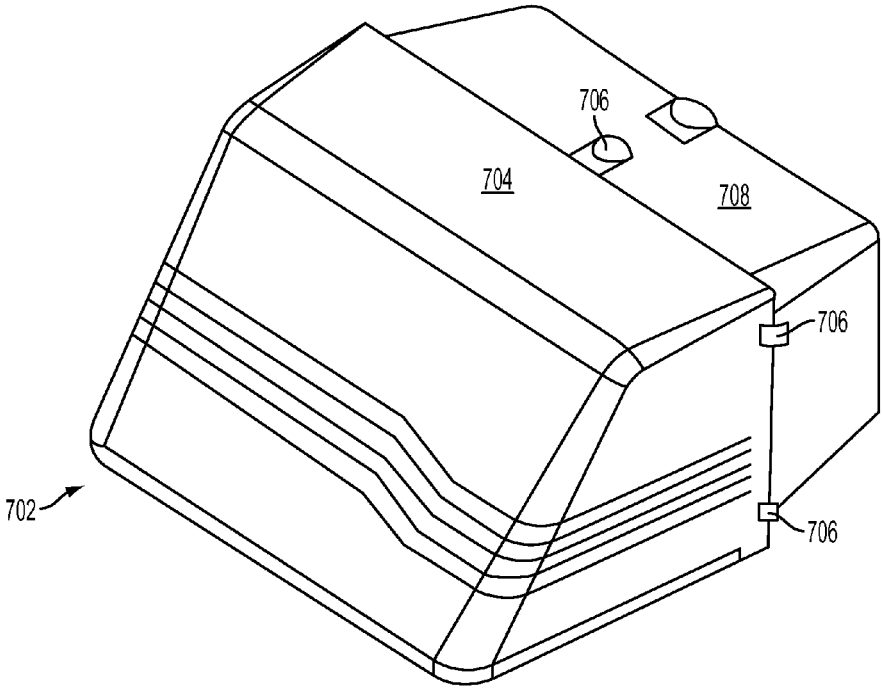
FIG. 7 is a side view of the wall pack type light fixture according to an embodiment of a bi-level hybrid light fixture.
Figure 8:
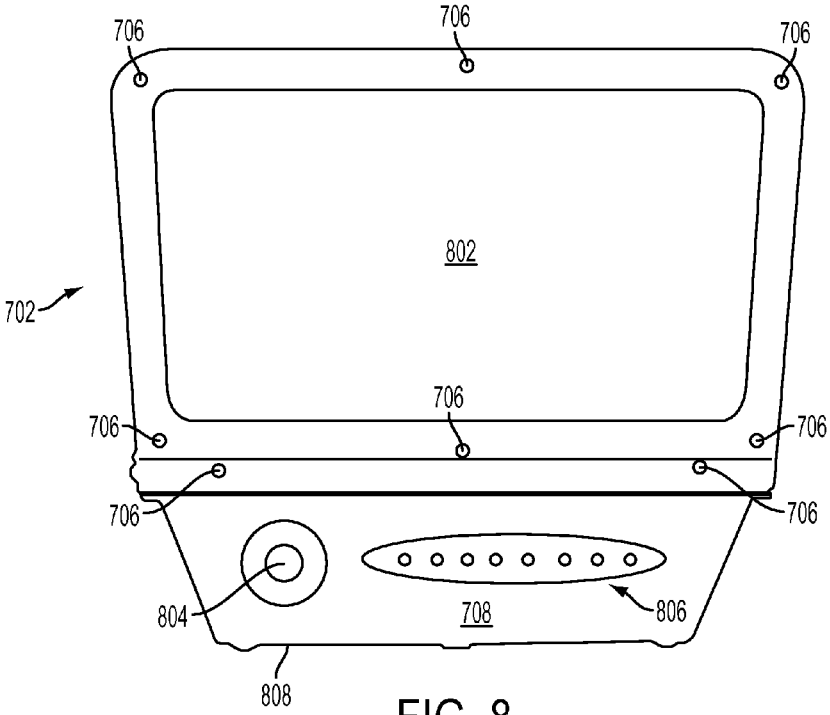
FIG. 8 is a bottom view of the FIG. 7 wall pack type light fixture.

FIG. 7 is a side view of a bi-level hybrid lighting device having a wall mount type light fixture 702 according to an embodiment of the present invention. Wall mount type light fixture 702 comprises a case 704 and a lens 802 (FIG. 8). Case 704 is removably attached to housing 708 by fasteners 706.

FIG. 8 is a bottom view of wall mount type light fixture 702. Case 704 is adapted to receive a lens 802. A plurality of secondary illuminants 806 and a sensor 804 are affixed to housing 708. Housing 708 comprises an edge 808, which may be removably attached to a mountable surface, such as a wall of a garage, house, parking structure, and adapted to received a power source to supply power to the first illuminant 902 (FIG. 9) and secondary illuminant 806.

Figure 9:
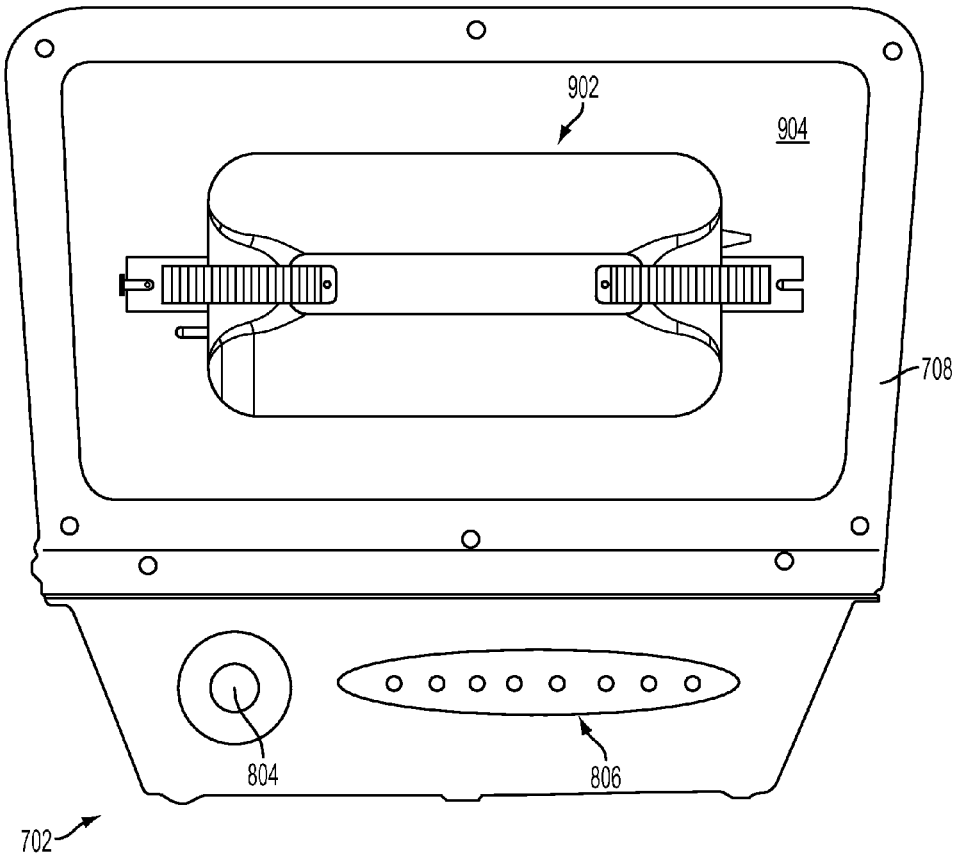
FIG. 9 is a bottom view of the FIG. 7 wall pack type light fixture having a lens removed.

FIG. 9 is a bottom view of wall mount type light fixture 702, where lens 802 is removed from the wall mount type fixture 702 to reveal a first illuminant 902 affixed to a surface 904 of case 704.

Figure 10:
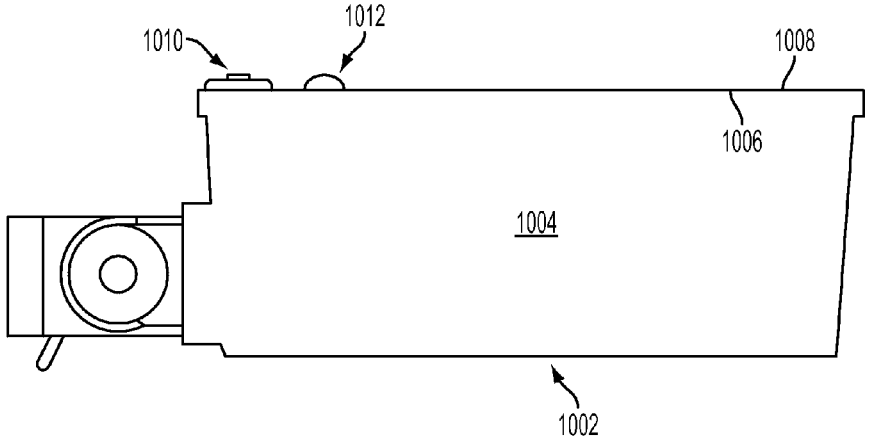
FIG. 10 is a side view of the area light type fixture according to an embodiment of a bi-level hybrid light fixture.

FIG. 10 is a side view of a bi-level hybrid lighting device having an area light type fixture 1002 according to an embodiment of the present invention. Area light type fixture 1002 comprises a case 1004. Case 1004 comprises a first housing 1006 and a second housing 1008. First housing 1006 and second housing 1008 are removably affixed via fasteners 1108 (FIG. 12).

Figure 11:
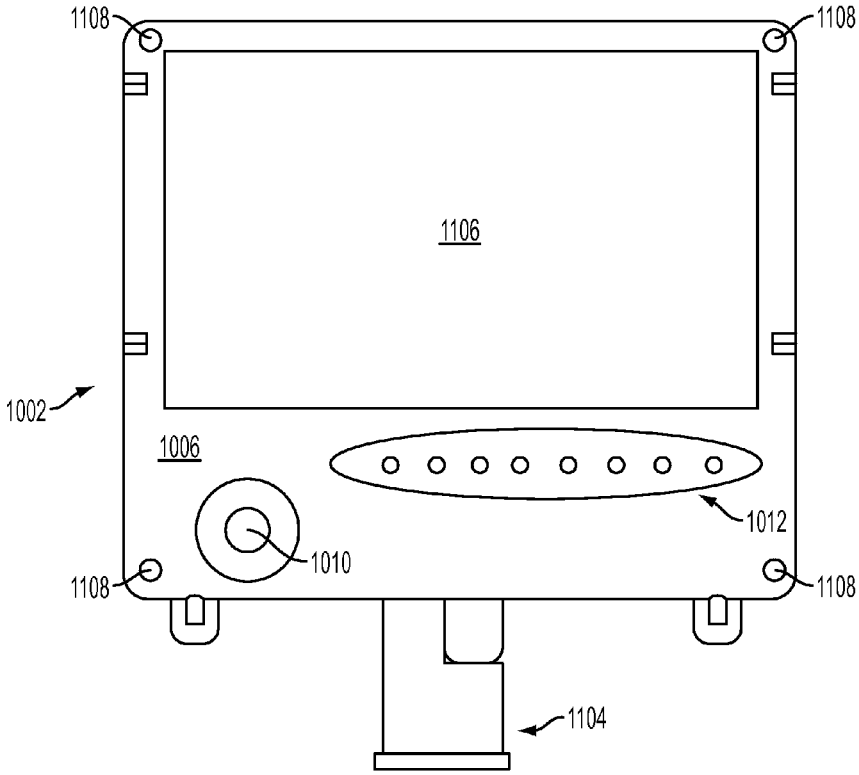
FIG. 11 is a bottom view of the FIG. 10 area light type fixture.

FIG. 11 is a bottom view of area light type fixture 1002. First housing 1006 of case 1004 is adapted to receive a lens 1106. A sensor 1010 and a plurality of secondary illuminants 1012 are affixed to first housing 1006. First housing 1006 comprises an edge 1102 which is removably attached to a mountable surface via a post 1104, such as a wall of a garage, house, parking structure, and adapted to received a power source to supply power to the first illuminant 1202 (FIG. 12) and the secondary illuminant 1012.

Figure 12:
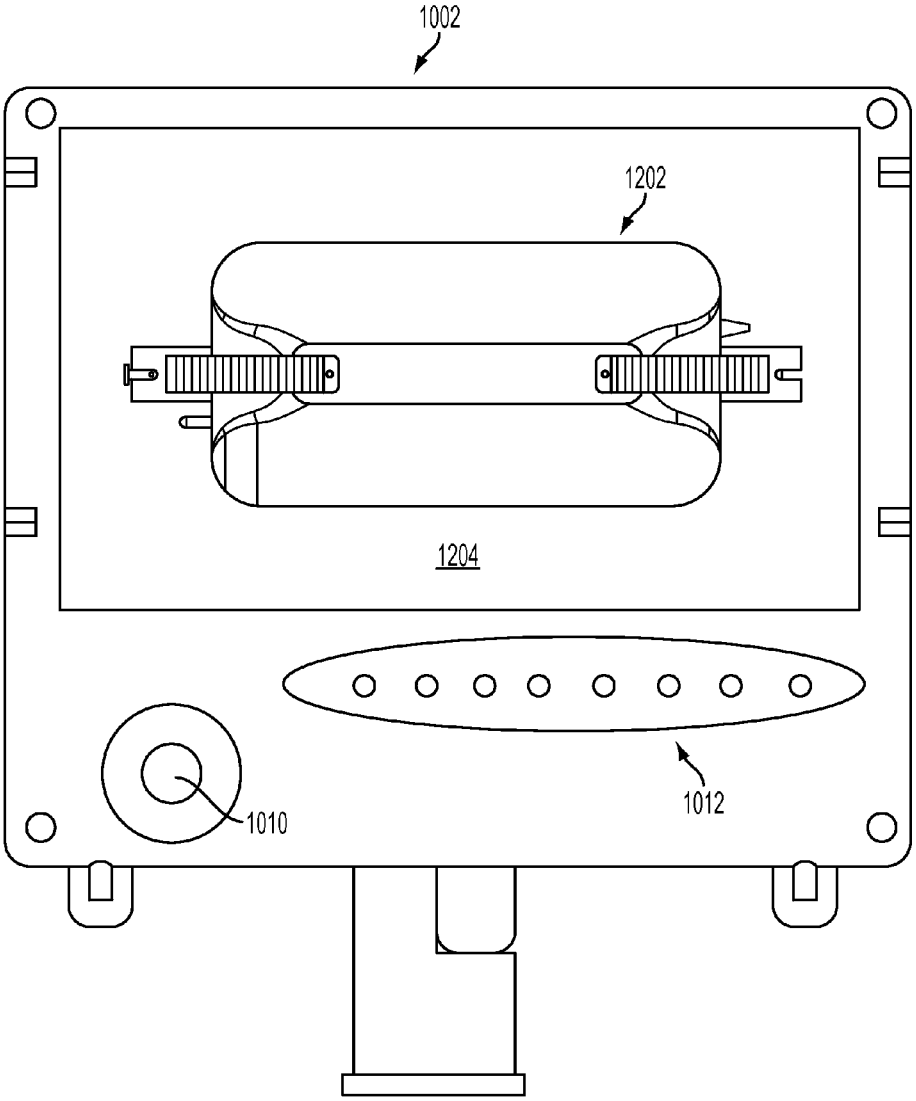
FIG. 12 is a bottom view of the FIG. 10 area light type fixture having a lens removed.

FIG. 12 is a bottom view of area light type fixture 1002. Lens 1106 is removed from the area light type fixture 1002 to reveal a first illuminant 1202 affixed to a surface 1204 of case 1004.

Figure 13:
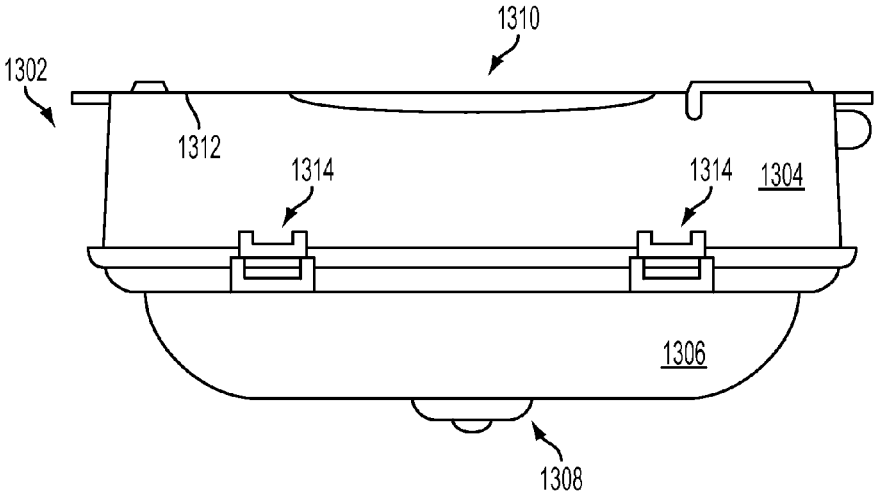
FIG. 13 a side view of the canopy type light fixture according to an embodiment of a bi-level hybrid light fixture.

FIG. 13 is a side view of a bi-level hybrid lighting device having a canopy type light fixture 1302 according to an embodiment of the present invention. Canopy type light fixture 1302 comprises a case 1304 and a lens 1306. Case 1304 comprises a rim 1312. Rim 1312 attaches to a secondary illuminant 1310. A sensor 1308 is affixed to lens 1306.

Figure 14:
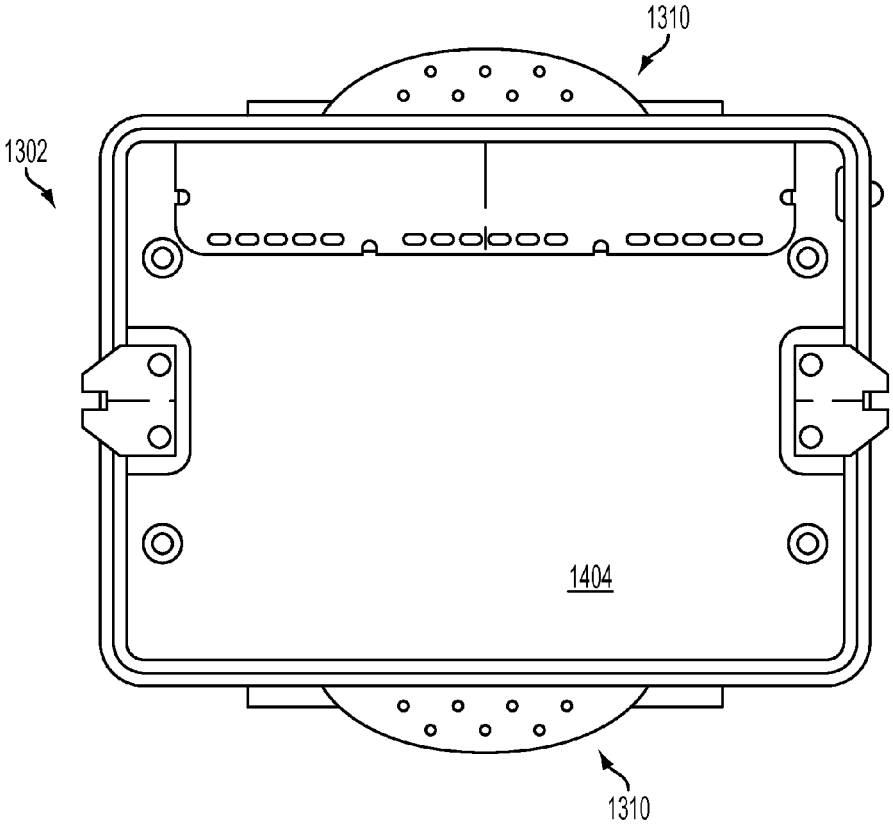
FIG. 14 is a bottom view of the FIG. 13 canopy type light fixture.

FIG. 14 is a top view of canopy type light fixture 1302. Lens 1306 is removably attached to case 1304 (FIG. 13) by a via a hinged latch device 1314. In other embodiments, the lens 1306 removably attaches to the case 1304 via a removable fastener or compression fittings. Case 1304 comprises an edge 1404. Edge 1404 may be removably attached to a mountable surface, such as a garage, canopy, parking structure, and adapted to received a power source to supply power to first illuminant 1504 (FIG. 15) and secondary illuminant 1310.

Figure 15:
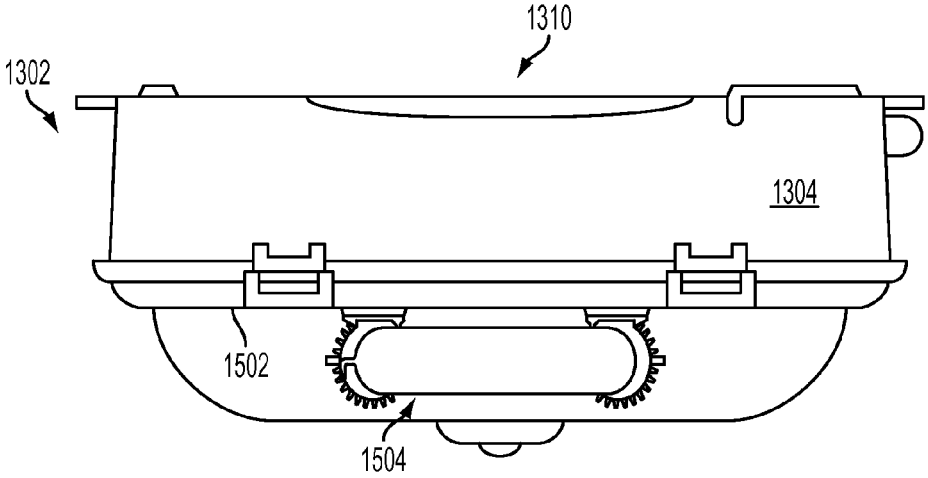
FIG. 15 is a side view of the FIG. 13 canopy type light fixture having a lens partially removed.

FIG. 15 is a side view of canopy type light fixture 1302, wherein lens 1306 is partially removed to reveal a first illuminant 1504. First illuminant 1504 is affixed to a surface 1502 of case 1304.

Figure 16:
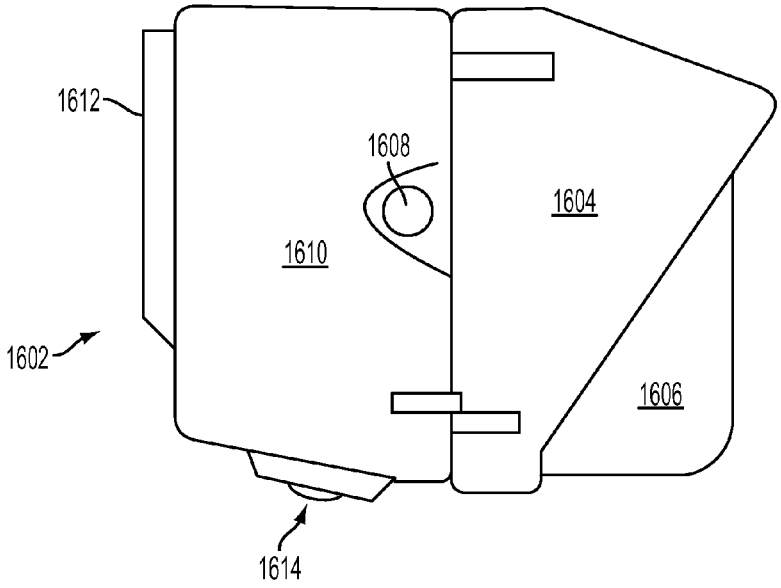
FIG. 16 a side view of the wall pack type light fixture according to an embodiment of a bi-level hybrid light fixture.

FIG. 16 is a side view of a bi-level hybrid lighting device having a wall pack type light fixture 1602 according to an embodiment of the present invention. Wall pack type fixture 1602 comprises a case 1604, a lens 1606, and a housing 1610. Case 1604 is removably attached to housing 1610, which are removably affixed via fasteners 1608.

Figure 17:
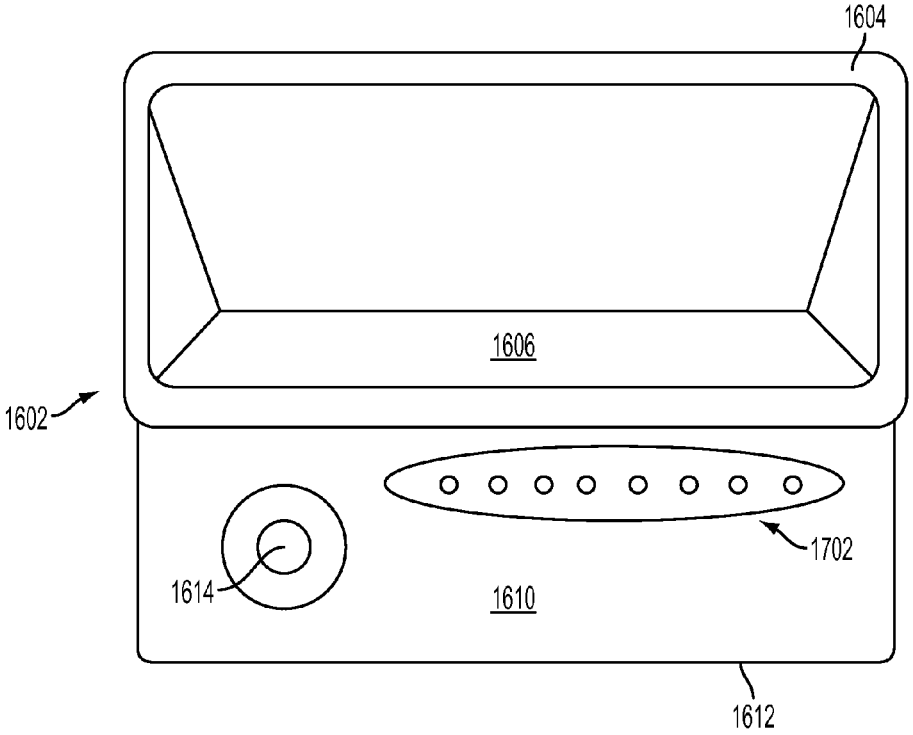
FIG. 17 is a bottom view of the FIG. 16 wall pack type light fixture.

FIG. 17 is a bottom view of wall pack type light fixture 1602. Case 1604 is adapted to received a lens 1606. A sensor 1614 and a secondary illuminant 1702 are affixed to housing 1610. Housing 1610 comprises an edge 1612, which may be removably attached to any mountable surface, such as a wall of a garage, house, parking structure, and adapted to receive a power source to supply power to first illuminant 1802 and secondary illuminant 1702.

Figure 18:
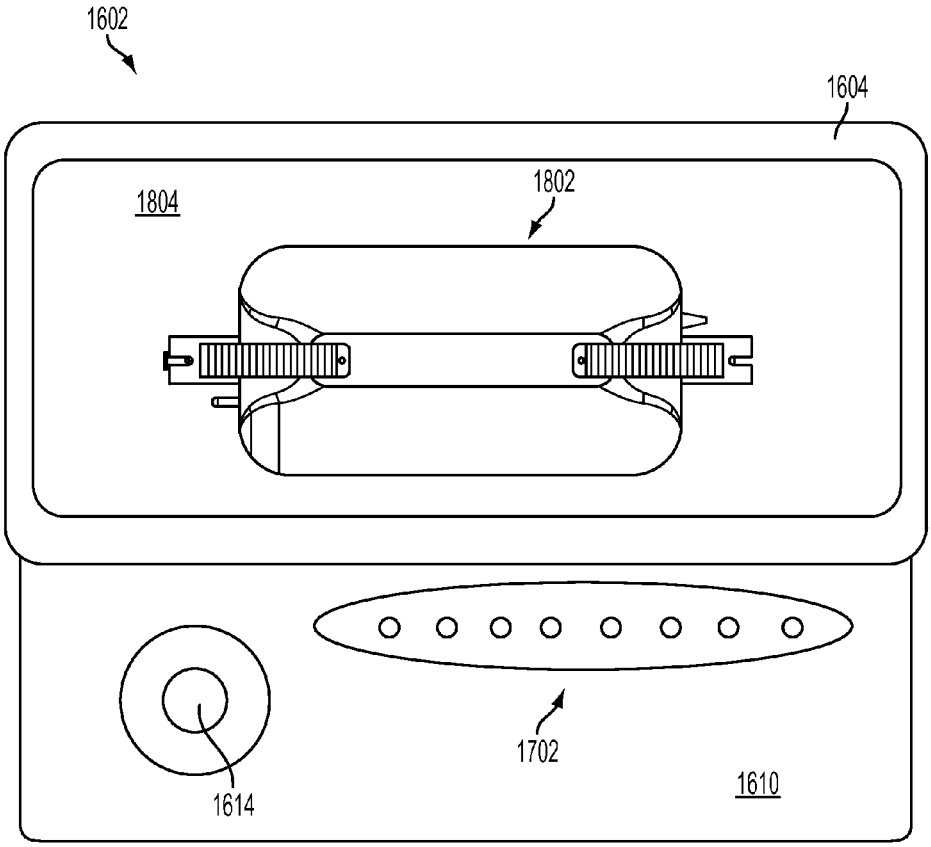
FIG. 18 is a bottom view of the FIG. 16 wall pack type light fixture having a lens removed.

FIG. 18 is a bottom view of wall pack type light fixture 1602, where the lens 1606 is removed to reveal a first illuminant 1802 affixed to a surface 1804 of case 1604.

Figure 20:
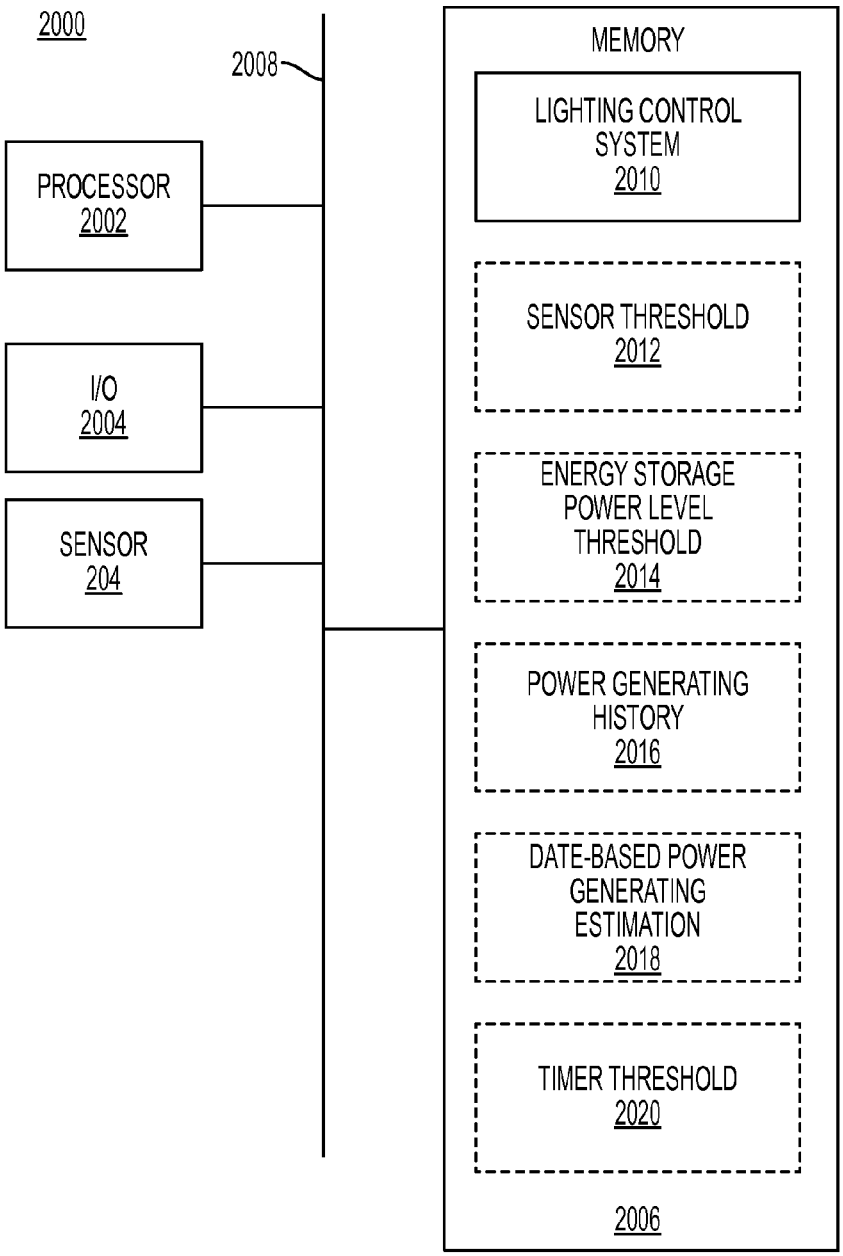
FIG. 20 is a high-level functional block diagram of a controller according to an embodiment.

FIG. 20 depicts a high-level functional block diagram of a controller 2000 usable in conjunction with an embodiment, e.g., as controller 2000 or as a controller integrated as part of a light fixture such as the shoe box, garage, wall pack, or walkway light fixtures. In one embodiment, controller 2000 is coupled to sensor 204 (FIG. 2), first illuminant 302 (FIG. 3) and secondary illuminant 118 (FIG. 1) to manage operation of the first illuminant 302 (FIG. 3) and secondary illuminant 118 (FIG. 1) based on pre-determined conditions detected by sensor 204 (FIG. 2).

Controller 2000 comprises a processor or controller-based device 2002, an input/output (I/O) device 2004, a memory 2006, and a sensor 204 each communicatively coupled with a bus 2008. Memory 2006 (which may also be referred to as a computer-readable medium) is coupled to bus 2008 for storing data and information and instructions to be executed by processor 2002. Memory 2006 also may be used for storing temporary variables or other intermediate information during execution of instructions to be executed by processor 2002. Memory 2006 may also comprise a read only memory (ROM) or other static storage device coupled to bus 2008 for storing static information and instructions for processor 2002. Memory 2006 may comprise static and/or dynamic devices for storage, e.g., optical, magnetic, and/or electronic media and/or a combination thereof.

I/O device 2004 may comprise a display, such as a cathode ray tube (CRT) or a flat panel display or other illuminating devices such as illuminated icons or pre-arranged light emitting diodes, for displaying information, alphanumeric and/or function keys for communicating information and command selections to the processor 2002, a cursor control device, such as a mouse, a trackball, or cursor direction keys for communicating direction information and command selections to the processor and for controlling cursor movement on the display, or a combination thereof. This input device typically has two degrees of freedom in two axes, a first axis (e.g., x) and a second axis (e.g., y) allowing the device to specify positions in a plane. In at least some embodiments, I/O device 2004 is optional.

Sensor 204 generates a motion and/or occupancy detection signal responsive to detection of motion and/or occupancy by living beings within a predetermined area adjacent first illuminant 302 and secondary illuminant 118. In at least some embodiments, sensor 204 is a motion sensor positioned to detect movement within the predetermined area. In at least some embodiments, sensor 204 is an occupancy sensor positioned to detect occupancy by living beings within the predetermined area. In at least some embodiments, sensor 204 generates radio frequency emissions, e.g., infrared and/or microwave or other emissions, toward the predetermined area and generates the detection signal in response to changes detected in return signals from the predetermined area. Sensor 204 generates the detection signal for use by lighting control system 2010 during execution by processor 2002.

Memory 2006 comprises a lighting control system 2010 according to one or more embodiments for determining illumination of induction-based light fixture 302 (FIG. 1). Lighting control system 2010 comprises one or more sets of instructions which, when executed by processor 2002, causes the processor to perform particular functionality. In at least some embodiments, lighting control system 2010 determines how long first illuminant 302 and/or secondary illuminant 118 should be illuminated based on at least signals, e.g., information and/or data, received from sensor 204 such as an occupancy and/or motion sensor, coupled to the controller.

In at least some further embodiments, lighting control system 2010 determines when and/or how long first illuminant 302 and/or secondary illuminant 118 should be illuminated based on a monitored power level of an energy storage device, monitored power generating patterns, e.g., with respect to one or both of solar panels and/or wind turbines, and/or a date-based information, or a combination thereof.

In at least one embodiment, lighting control system 2010 determines if first illuminant 302 and/or secondary illuminant 118 should be illuminated responsive to receipt of a motion/occupancy detection signal from sensor 204. Lighting control system 2010 determines if first illuminant 302 and/or secondary illuminant 118 should be illuminated based on comparing the detection signal value (if applicable) with a sensor threshold value 2012 stored in memory 2006. If the detection signal value meets or exceeds the sensor threshold value 2012, control system 2010 causes activation of first illuminant 302 and/or secondary illuminant 118.

In at least some embodiments, sensor threshold value 2012 may specify one or more different threshold values. In accordance with such an embodiment, if the detection signal exceeds a lowest threshold value and not a next higher threshold value, first illuminant 302 and/or secondary illuminant 118 may be activated at a reduced or dimmed illumination level. If the detection signal exceeds each of the threshold values, first illuminant 302 and/or secondary illuminant 118 may be activated at a full illumination level.

In at least some embodiments, lighting control system 2010 executes a timer function in conjunction with monitoring for the detection signal in order to dim the illumination level of first illuminant 302 and/or secondary illuminant 118 during periods of inactivity in the predetermined area adjacent the lighting device. For example, if the timer has exceeded a predetermined inactivity threshold value 2020 (stored in memory 2006), lighting control system 2010 causes first illuminant 302 and/or secondary illuminant 118 to reduce the illumination level to a dimmed level, e.g., a predetermined percentage of the full output level of the device. In at least some embodiments, lighting control system 2010 resets or restarts timer responsive to receipt of a detection signal from sensor 204.

In at least one embodiment, lighting control system 2010 determines how long first illuminant 302 and/or secondary illuminant 118 should be illuminated based on comparing an energy potential stored in an energy storage device with an energy storage power level threshold 2014 stored in memory 2006. In at least some embodiments, energy storage power level threshold 2014 comprises a set of values corresponding to different durations in which first illuminant 302 and/or secondary illuminant 118 may be illuminated. For example, at a first threshold level, controller 2000 may cause first illuminant 302 and/or secondary illuminant 118 to illuminate for 4 hours, at a second lower threshold level, the controller may cause the first illuminant 302 and/or secondary illuminant 118 to illuminate for 2 hours, etc. In at least some embodiments, energy storage power level threshold 2014 comprises a single value above which the energy storage power level must exceed in order for controller 2000 to cause the light source to illuminate. The energy storage power level threshold 2014 may be predetermined and/or user input to controller 2000.

In at least one embodiment, lighting control system 2010 determines how long first illuminant 302 and/or secondary illuminant 118 should be illuminated based on comparing a power generating history 2016 stored in memory 2006. Power generating history 2016 may comprise a single value or a set of values corresponding to a time and/or date based history of the power generated by one or both or each of solar panels and wind turbines. For example, lighting control system 2010 may apply a multi-day moving average to the power generating history of one or both or each of solar panels and wind turbines in order to determine the power generating potential for subsequent periods and estimate based thereon the amount of power which may be expended to illuminate first illuminant 302 and/or secondary illuminant 118 during the current period. In at least one embodiment, lighting control system 2010 applies a three (3) day moving average to the power generating history of one or both of solar panels and wind turbines.

In at least one embodiment, lighting control system 2010 determines how long first illuminant 302 and/or secondary illuminant 118 should be illuminated based on a date-based power generating estimation 2018 stored in memory 2006. For example, depending on a geographic installation location of lighting device 102 (FIG. 1), controller 2000 may determine the illumination of first illuminant 302 and/or secondary illuminant 118 based on a projected amount of daylight for the particular location, e.g., longer periods of darkness during winter in Polar locations as opposed to Equatorial locations. In at least some further embodiments, controller 2000 may be arranged to cause illumination of first illuminant 302 and/or secondary illuminant 118 for a predetermined period of time based on information from one or more of energy storage power level threshold 2014, power generating history 2016, and/or date-based power generating estimation 2018 and after termination of the predetermined period be arranged to cause illumination of the light source responsive to a signal from a motion sensor for a second predetermined period of time.

In at least some further embodiments, lighting control system 2010 determines when first illuminant 302 and/or secondary illuminant 118 should be illuminated based on receipt of a signal from an occupancy or traffic detector, e.g., a motion sensor operatively coupled with controller 2000.

In at least some embodiments, controller 2000 also comprises an electrical connection to a mains power supply. The mains power supply connection may be used in a backup/emergency situation if neither of the solar panels, wind turbine, or energy storage device are able to supply sufficient power levels to power first illuminant 302 and/or secondary illuminant 118. In another embodiment, the mains power supply connection may be used to return power generated by first illuminant 302 and/or secondary illuminant 118 to a power supply grid. In at least some embodiments, the returned electric power may be returned for free or for a predetermined price.

In at least some embodiments, controller 2000 regulates the supply of electricity to first illuminant 302 and/or secondary illuminant 118. By regulating the supplied electricity, controller 2000 may prevent and/or minimize unexpected spikes or drops in the supplied electricity level to first illuminant 302 and/or secondary illuminant 118. In at least some embodiments, controller 2000 may also direct from which component first illuminant 302 and/or secondary illuminant 118 receives electricity, e.g., energy storage device or directly from wind turbine, solar panels, etc.

In at least some embodiments, controller 2000 also comprises a light sensor to determine if a predetermined threshold has been met in order to transfer electricity to first illuminant 302 and/or secondary illuminant 118 to cause the light source to activate and generate illumination. In at least some alternate embodiments, first illuminant 302 and/or secondary illuminant 118 comprises the light sensor. The light sensor is a switch controlled by a detected light level, e.g., if the light level is below a predetermined threshold level, the switch is closed and electricity flows to first illuminant 302 and/or secondary illuminant 118.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

Figure 21:
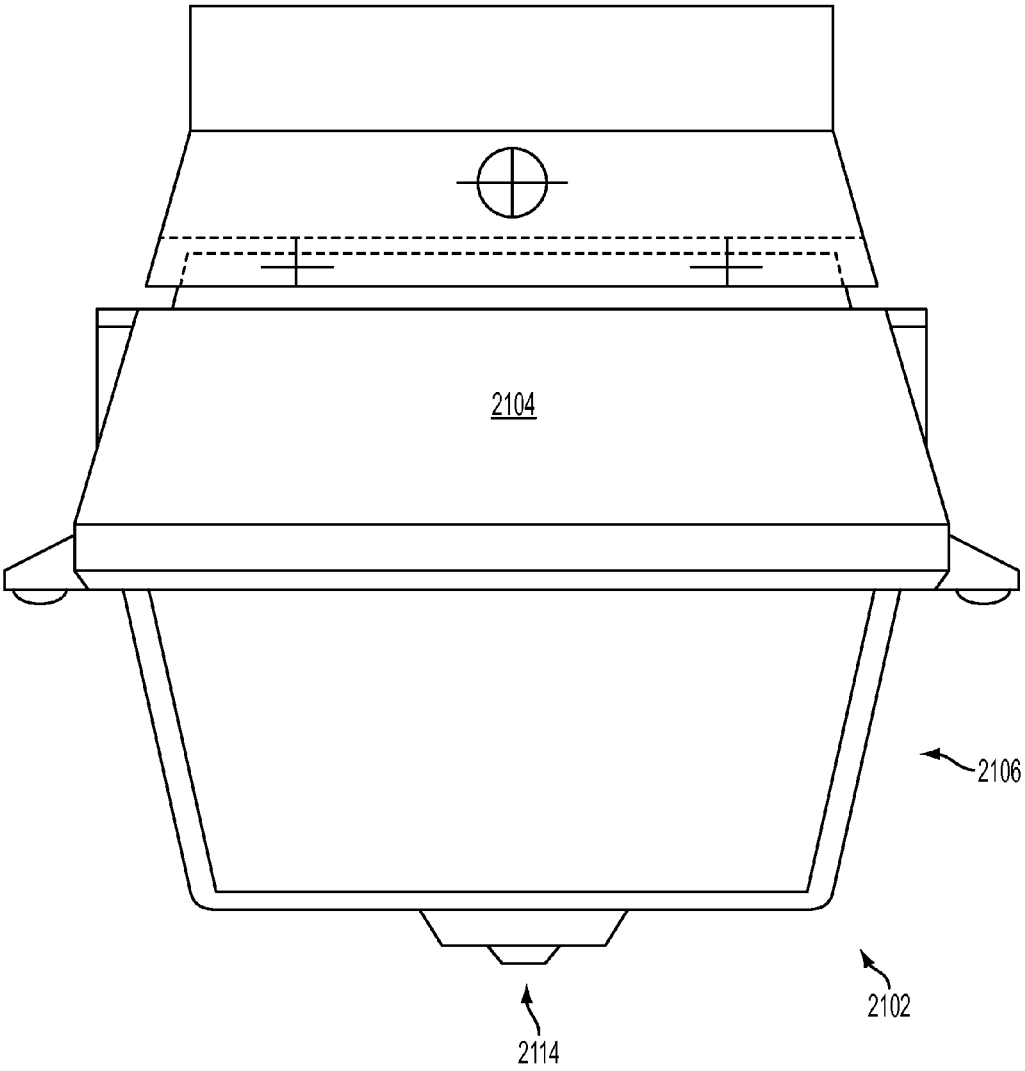
FIG. 21 is a side view of the garage type light fixture according to an embodiment of a bi-level hybrid light fixture.

FIG. 21 is a side view of a bi-level hybrid lighting device having a garage type light fixture 2102 according to an embodiment of the present invention. Garage type light fixture 2102 comprises a case 2104 and a lens 2106. Affixed to lens 2106 is a sensor 2114.

Figure 22:
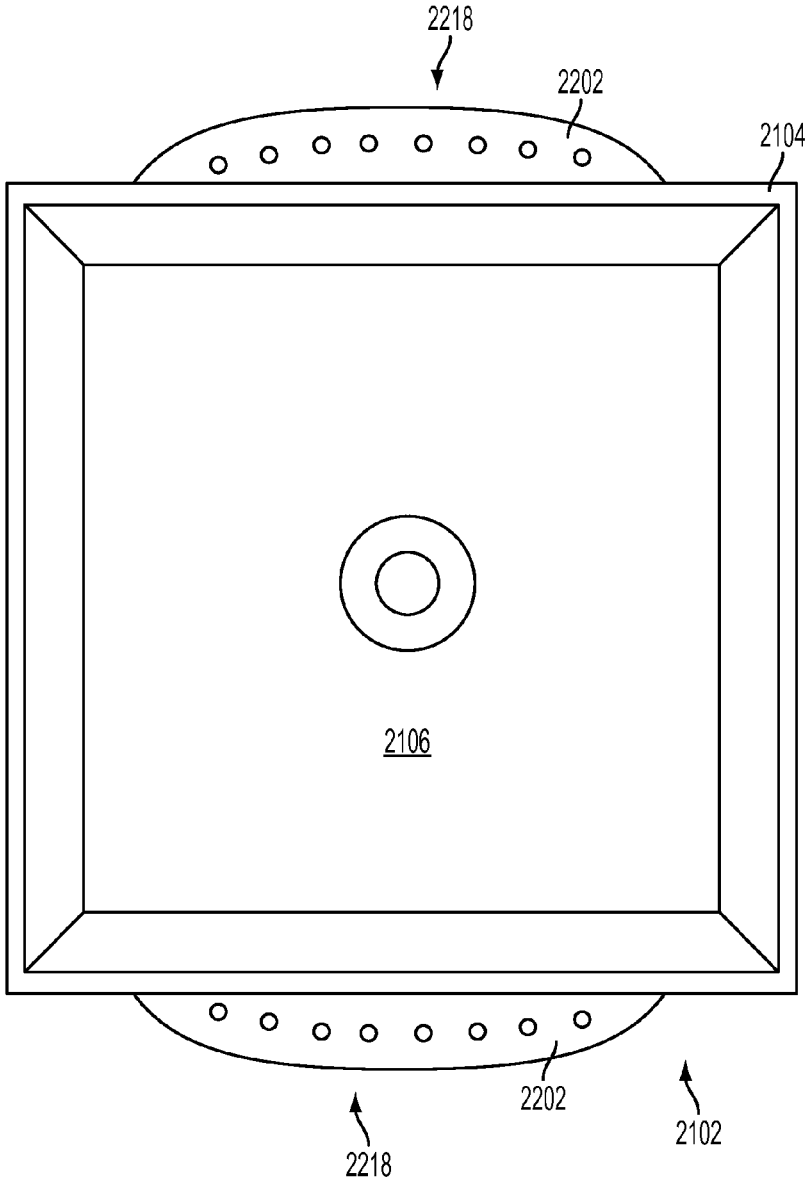
FIG. 22 is a bottom view of the FIG. 21 garage type light fixture.

FIG. 22 is a bottom view of garage type light fixture 2102 (FIG. 4). Lens 2106 is affixed to case 2104 by way of a twist-lock ring. In other embodiments, lens 2106 may be affixed to case 2104 by way of a fastener or compression fitting.

Case 2104 comprises a rim 2202 attached to or having attached thereto a plurality of secondary illuminants 2218. In other embodiments, a single secondary illuminant is used depending on the intensity and desired effects of the secondary illuminant.

Figure 23:
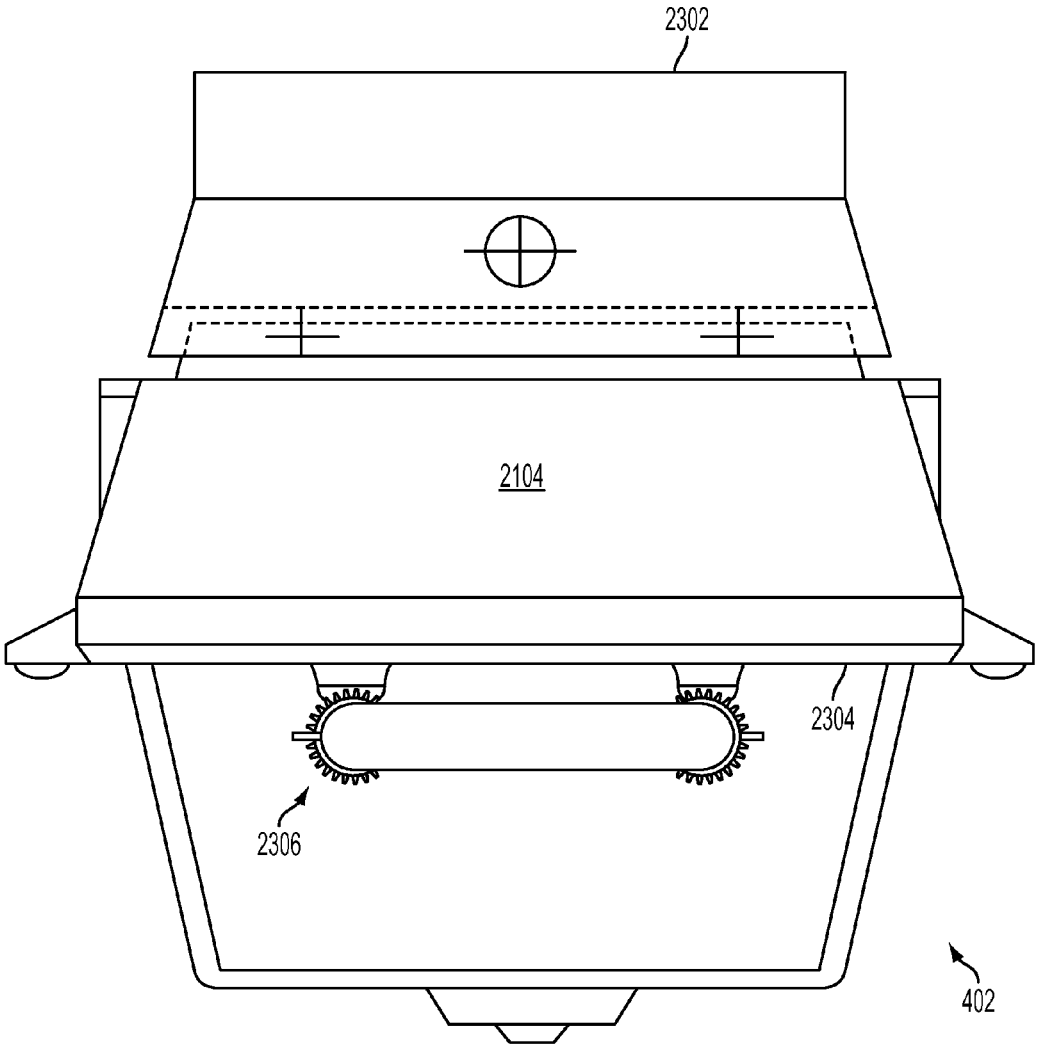
FIG. 23 is a side view of the FIG. 21 garage type light fixture having a lens partially removed.

FIG. 23 is a side view of garage type light fixture 402 (FIG. 4), wherein lens 2106 is partially removed to reveal a first illuminant 2306 affixed to a surface 2304 of case 2104.

Garage type light fixture 2102 comprises an edge 2302. Edge 2302 removably attaches to a mountable surface, such as a garage, canopy, parking structure, and adapted to receive a power source to supply power to the first illuminant 2306 and secondary illuminants 2218.

What is claimed is:

1. A lighting fixture system, comprising:

a first illuminant;

a secondary illuminant; and a sensor configured to detect a predetermined condition, the sensor being coupled to the first illuminant and the secondary illuminant, the first illuminant and the secondary illuminant comprising different light sources, the sensor configured to cause modulation of the first illuminant and the secondary illuminant in response to detection of the pre-determined condition, wherein the modulation comprises dimming an illumination level of at least one of the first illuminant or the secondary illuminant.

2. The lighting fixture system as claimed in claim 1, wherein the first illuminant is an induction based light source.

3. The lighting fixture system as claimed in claim 1, wherein the secondary illuminant is an LED based light source.

4. The lighting fixture system as claimed in claim 1, wherein the secondary illuminant is configured to generate visible light at a wavelength greater than 480 nanometers.

5. The lighting fixture system as claimed in claim 1, wherein the sensor is an occupancy sensor.

6. The lighting fixture system as claimed in claim 1, wherein the first illuminant is configured to generate a color temperature different from the secondary illuminant.

7. The lighting fixture system as claimed in claim 1, wherein the secondary illuminant is an amber LED.

8. The lighting fixture system as claimed in claim 1 further comprising a controller coupled between the sensor and the first illuminant and the second illuminant.

9. The lighting fixture system as claimed in claim 1 further comprising a communication system, where the communication system is electrically coupled to the first illuminant and the secondary illuminant and the communication system is configured to modulate between the first illuminant and the secondary illuminant based on a pre-determined condition.

10. The lighting fixture system as claimed in claim 1, wherein the secondary illuminant is configured to generate visible light at a wavelength that reduces the impact of biological disturbances.

11. A lighting fixture system, comprising:

a first illuminant;

a secondary illuminant, wherein the secondary illuminant is an amber LED; and a communication system, where the communication system is electrically coupled to the first illuminant and secondary illuminant and the communication system is configured to modulate between the first illuminant and the secondary illuminant based on a pre-determined condition.

12. The lighting fixture system as claimed in claim 11, wherein the first illuminant is an induction based light source.

13. The lighting fixture system as claimed in claim 11, wherein the secondary illuminant is an LED based light source.

14. The lighting fixture system as claimed in claim 11, wherein the secondary illuminant is configured to generate visible light at a wavelength greater than 480 nanometers.

15. The lighting fixture system as claimed in claim 11 further comprising a sensor configured to detect a predetermined condition, the sensor being coupled to the first illuminant and the secondary illuminant, the first illuminant and the secondary illuminant comprising different light sources, the sensor configured to cause modulation of the first illuminant and the secondary illuminant in response to detection of the pre-determined condition.

16. The lighting fixture system as claimed in claim 15 wherein the sensor is an occupancy sensor.

17. The lighting fixture system as claimed in claim 11, wherein the first illuminant is configured to generate a color temperature different from the secondary illuminant.

18. The lighting fixture system as claimed in claim 11 further comprising a controller coupled between the sensor and the first illuminant and the second illuminant.

19. The lighting fixture system as claimed in claim 11, wherein the secondary illuminant is configured to generate visible light at a wavelength that reduces the impact of biological disturbances.

20. A lighting fixture system, comprising:

a first illuminant being an induction based light source;

a secondary illuminant being an LED based light source;

a sensor configured to detect a predetermined condition, the sensor being coupled to the first illuminant and the secondary illuminant, the first illuminant and the secondary illuminant comprising different light sources, the sensor configured to cause modulation of the first illuminant and the secondary illuminant in response to detection of the pre-determined condition, wherein the modulation comprises dimming an illumination level of at least one of the first illuminant or the secondary illuminant; and a communication system, where the communication system is electrically coupled to the first illuminant and secondary illuminant and the communication system is configured to modulate between the first illuminant and the secondary illuminant based on a pre-determined condition.

21. The lighting fixture system of claim 20, wherein the secondary illuminant is an amber LED.

* * * * *